US009155404B2

(12) United States Patent
Axtell

(10) Patent No.: US 9,155,404 B2
(45) Date of Patent: Oct. 13, 2015

(54) INFANT SUPPORT INSERT ASSEMBLY

(71) Applicant: Gina A. Axtell, Jupiter, FL (US)

(72) Inventor: Gina A. Axtell, Jupiter, FL (US)

( * ) Notice: Subject to any disclaimer, the term of this patent is extended or adjusted under 35 U.S.C. 154(b) by 0 days.

(21) Appl. No.: 13/653,183

(22) Filed: Oct. 16, 2012

(65) Prior Publication Data

US 2014/0101858 A1 Apr. 17, 2014

(51) Int. Cl.
*A47D 15/00* (2006.01)
*A47D 13/04* (2006.01)

(52) U.S. Cl.
CPC ..... *A47D 15/006* (2013.01); *A47D 13/04* (2013.01); *A47D 13/043* (2013.01)

(58) Field of Classification Search
CPC .... B60N 2/2881; A47C 7/024; A47C 27/144; A47C 16/00; A61G 2005/1045; A47D 13/08; A47D 15/005; A47D 15/006; A47D 15/008; A47D 13/04; A47D 13/043; A47D 13/046; A47G 2009/1018; A47G 9/1027; A47G 9/1054; A47G 9/1081
USPC ..... 5/630, 632, 640, 646, 648, 652, 653, 5/655, 655.9, 657; 297/219.12, 312; 280/87.051
See application file for complete search history.

(56) References Cited

U.S. PATENT DOCUMENTS

| | | | | | |
|---|---|---|---|---|---|
| 909,453 | A | | 1/1909 | Pullman | |
| 1,776,122 | A | * | 9/1930 | Krasnick | 297/467 |
| 2,429,498 | A | * | 10/1947 | Wells | 297/135 |
| 2,711,328 | A | * | 6/1955 | Shone et al. | 280/643 |
| 2,765,839 | A | * | 10/1956 | Arpin | 280/87.051 |
| 3,148,914 | A | * | 9/1964 | Steely | 297/149 |
| 3,606,461 | A | * | 9/1971 | Moriyama | 97/451.8 |
| 3,784,224 | A | * | 1/1974 | Peeler | 297/471 |
| 3,788,699 | A | * | 1/1974 | Starr | 297/488 |
| 3,860,976 | A | * | 1/1975 | Suyama | 4/575.1 |
| 3,890,658 | A | * | 6/1975 | Petersilie | 5/2.1 |
| D240,177 | S | * | 6/1976 | Petersilie | D6/335 |
| 4,143,915 | A | * | 3/1979 | Kamlay | 297/488 |
| 4,165,123 | A | * | 8/1979 | Hutson | 297/153 |
| 4,980,937 | A | * | 1/1991 | Mason et al. | 5/655 |
| 5,106,156 | A | * | 4/1992 | Marquis | 297/153 |
| 5,219,309 | A | * | 6/1993 | Hart | 441/136 |
| 5,261,134 | A | | 11/1993 | Matthews | |
| 5,313,678 | A | * | 5/1994 | Redewill | 5/639 |

(Continued)

FOREIGN PATENT DOCUMENTS

| | | | |
|---|---|---|---|
| GB | 2208793 | A | 4/1989 |
| GB | 2227409 | A | 8/1990 |
| GB | 2269741 | A | 2/1994 |

*Primary Examiner* — David E Sosnowski
*Assistant Examiner* — Eric Kurilla
(74) *Attorney, Agent, or Firm* — Simpson & Simpson, PLLC

(57) ABSTRACT

A support insert assembly including a first member having first and second curved side surfaces parallel to a first direction, first and second planar partial ring-shaped surfaces connecting the first and second curved side surfaces, and first and second end surfaces connected to the first and second curved side surfaces and the first and second planar partial ring-shaped surfaces; and a second member having a third curved side surface, a straight side surface parallel to the direction, and first and second hemispherically-shaped planar surfaces connected to the third curved side surface and the straight side surface and parallel to one another, where the first and second members are arranged in an opening tar a seating arrangement for the infant to form a space enclosed by the straight side surface and the first curved side surface, and the space is arranged to receive and support the infant.

16 Claims, 5 Drawing Sheets

(56) References Cited

U.S. PATENT DOCUMENTS

| | | | | |
|---|---|---|---|---|
| 5,324,064 | A * | 6/1994 | Sumser et al. | 280/649 |
| 5,581,833 | A * | 12/1996 | Zenoff | 5/655 |
| 5,647,076 | A * | 7/1997 | Gearhart | 5/631 |
| 5,662,344 | A * | 9/1997 | Lu | 280/87.051 |
| 5,664,828 | A * | 9/1997 | Simon | 297/153 |
| 5,732,999 | A * | 3/1998 | Petrie | 297/136 |
| 5,765,502 | A * | 6/1998 | Haugh | 119/28.5 |
| 5,790,999 | A * | 8/1998 | Clark | 5/655 |
| 5,800,020 | A * | 9/1998 | Brock | 297/488 |
| 5,813,720 | A * | 9/1998 | Huang | 297/5 |
| 5,967,607 | A * | 10/1999 | Waldroup | 297/256.17 |
| 6,000,761 | A * | 12/1999 | Rocha | 297/464 |
| 6,048,290 | A * | 4/2000 | Chen et al. | 482/68 |
| 6,079,067 | A * | 6/2000 | Becker et al. | 5/655 |
| 6,088,855 | A | 7/2000 | Connolly | |
| 6,142,261 | A * | 11/2000 | Yang | 188/20 |
| 6,230,352 | B1 * | 5/2001 | Kasem | 5/737 |
| 6,231,056 | B1 * | 5/2001 | Wu | 280/7.17 |
| 6,260,867 | B1 * | 7/2001 | Yang et al. | 280/87.051 |
| 6,266,832 | B1 * | 7/2001 | Ezell | 5/640 |
| D450,517 | S * | 11/2001 | Darling et al. | D6/601 |
| 6,402,251 | B1 * | 6/2002 | Stoll | 297/485 |
| 6,467,840 | B1 * | 10/2002 | Verbovszky et al. | 297/219.12 |
| 6,626,487 | B1 * | 9/2003 | Buitendach | 297/153 |
| 6,659,545 | B1 * | 12/2003 | McMillan | 297/153 |
| 6,685,024 | B1 | 2/2004 | Matthews | |
| 6,779,211 | B1 | 8/2004 | Williams | |
| 6,810,545 | B1 | 11/2004 | Darling et al. | |
| 6,918,149 | B2 | 7/2005 | Gowaty | |
| 7,010,821 | B1 * | 3/2006 | Leach | 5/655 |
| 7,356,861 | B1 * | 4/2008 | Pagano | 5/655 |
| 7,451,508 | B2 | 11/2008 | Matthews Brown et al. | |
| 7,464,423 | B2 * | 12/2008 | Goodwin et al. | 5/655 |
| 7,654,613 | B2 * | 2/2010 | Bass | 297/250.1 |
| 7,698,763 | B2 * | 4/2010 | Warnock | 5/655 |
| 7,788,752 | B2 | 9/2010 | Tidwell et al. | |
| 7,810,193 | B1 * | 10/2010 | Ennis et al. | 5/655.3 |
| 7,935,031 | B1 * | 5/2011 | Hsiao | 482/68 |
| 8,104,780 | B1 * | 1/2012 | Mcconnell-Copploe et al. | 280/87.051 |
| 8,162,333 | B1 * | 4/2012 | Bartlett | 280/87.05 |
| 8,418,295 | B2 * | 4/2013 | Clark | 5/655 |
| 8,585,144 | B2 * | 11/2013 | Huttenhuis | 297/312 |
| 8,695,137 | B1 * | 4/2014 | Hanson | 5/655 |
| 8,727,448 | B1 * | 5/2014 | Pagano | 297/464 |
| 8,764,109 | B2 * | 7/2014 | Kummerfeld et al. | 297/250.1 |
| 8,783,776 | B1 * | 7/2014 | Perkins | 297/392 |
| 8,944,514 | B2 * | 2/2015 | Tadin et al. | 297/440.11 |
| 2003/0184036 | A1 * | 10/2003 | Wu | 280/87.051 |
| 2004/0075231 | A1 * | 4/2004 | Hou et al. | 280/87.051 |
| 2004/0261181 | A1 * | 12/2004 | Gowaty | 5/655 |
| 2005/0235425 | A1 * | 10/2005 | Parrilla | 5/655 |
| 2006/0265809 | A1 * | 11/2006 | Wagner | 5/655 |
| 2007/0108810 | A1 * | 5/2007 | Nishimoto et al. | 297/219.12 |
| 2008/0054696 | A1 * | 3/2008 | McConnell et al. | 297/256.15 |
| 2009/0151079 | A1 | 6/2009 | Espindola et al. | |
| 2010/0176626 | A1 * | 7/2010 | Centracco et al. | 297/136 |
| 2011/0018216 | A1 * | 1/2011 | Cheng | 280/87.051 |

* cited by examiner

INFANT SUPPORT INSERT ASSEMBLY

FIELD OF THE INVENTION

The invention broadly relates to a support insert, and, more particularly, to a support insert operatively arranged to hold a child in a substantially vertical position in a seat, for example, an entertainer, bouncer, or high chair.

BACKGROUND OF THE INVENTION

It is know to us an infant supports in the form of a substantially C-shaped member. The infant's back rests upon the interior surface of the C-shaped member and the arms of the C-shaped member cradle the infant. For example, U.S. Pat. No. 6,779,211 to (Williams) discloses a baby support assembly comprising two C-shaped members. The C-shaped members are stackable about one another to support the back of an infant; however, there is no support for the front of an infant. Because of the lack of front support, an infant who is not yet stable can easily fall forward and sustain an injury.

Known infant supports typically have substantially rounded edges and are operatively arranged to be used independently. When inserted into a child seat device, such as an entertainer, bouncer, or high chair, the rounded edges prevent a proper fit and lack stability.

BRIEF SUMMARY OF THE INVENTION

The present invention broadly comprises a support insert assembly including a first member and a second member. The first member has first and second curved side surfaces parallel to one another, first and second planar partial ring-shaped surfaces connecting the first and second curved side surfaces, and first and second end surfaces connected to the first and second curved side surfaces and the first and second planar partial ring-shaped surfaces. The second member has a third curved side surface, a straight side surface in communication with the third curved side surface, and first and second hemispherical planar surfaces connected to the third curved side surface and the straight side surface and parallel to one another, where the first and second members are arranged to be located in an opening for a seating arrangement for the infant to form a space at least partially enclosed by the straight side surface and the first curved side surface, and the space is arranged to receive and support the infant.

In one embodiment, the first and second planar partial ring-shaped surfaces form respective semi-circular rings; and the first and second end surfaces are aligned with respective diameters for the respective semi-circular rings. The first member and the second member are operatively arranged to support a child, such that when positioned in an apparatus, the first and second end surfaces of the first member are arranged substantially parallel to and diametrically opposed to the straight side surface of the second member. Preferably, the first and second end surfaces and the straight side surface are in contact with one another. The first member and the second member each further include a plurality of edges, such that the adjacent edges intersect at substantially right angles.

In one embodiment, the support insert assembly is made of a foam material, such as polyurethane, latex, plastic, etc. it should be appreciated, however, that the support insert assembly can be made of any suitable material. The first member has a first diameter and the first diameter is approximately 8 inches. Additionally, the first and second end surfaces each have a width where each of the widths is substantially parallel to the first and second planar partial ring-shaped surfaces and is approximately 3 inches. The first and second hemispherically-shaped planar surfaces have respective diameters of approximately 8.5 inches. The first member can be any suitable shape but preferably C-shaped or U-shaped. Furthermore, the first member has a cross-section that is substantially arcuate and the second member has a cross-section that is substantially semicircular. Moreover, the first member further includes a first cover and the second member further includes a second cover, where the first and second covers encase the first and second members, respectively. Preferably, the first and second covers are made of a fabric material, such as cotton, polyester, nylon, rayon, microfiber, etc. However, it should be appreciated that the fabric covers can be made of any suitable material.

The present invention also includes a method of supporting an infant in an upright position in a device using a support assembly including a first member with: first and second curved side surfaces parallel to one another; first and second planar partial ring-shaped surfaces connecting the first and second curved side surfaces; and first and second end surfaces connected to the first and second curved side surfaces and the first and second planar partial ring-shaped surfaces; and a second member with: a third curved side surface; a straight side surface in communication with the third curved side surface; and first and second hemispherically-shaped planar surfaces connected to the third curved side surface and the straight side surface and parallel to one another. The method includes: inserting the first member into an opening of the device; inserting the second member into the opening of the device such that a space is formed between the first curved side surface and the straight side surface; and positioning the infant in the space such that the infant is in contact with the straight side surface and the second curved side surface.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and, as such, may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. Although any methods, devices or materials similar or equivalent to those described herein can be used in the practice or testing of the invention, the preferred methods, devices, and materials are now described.

Figure 1:
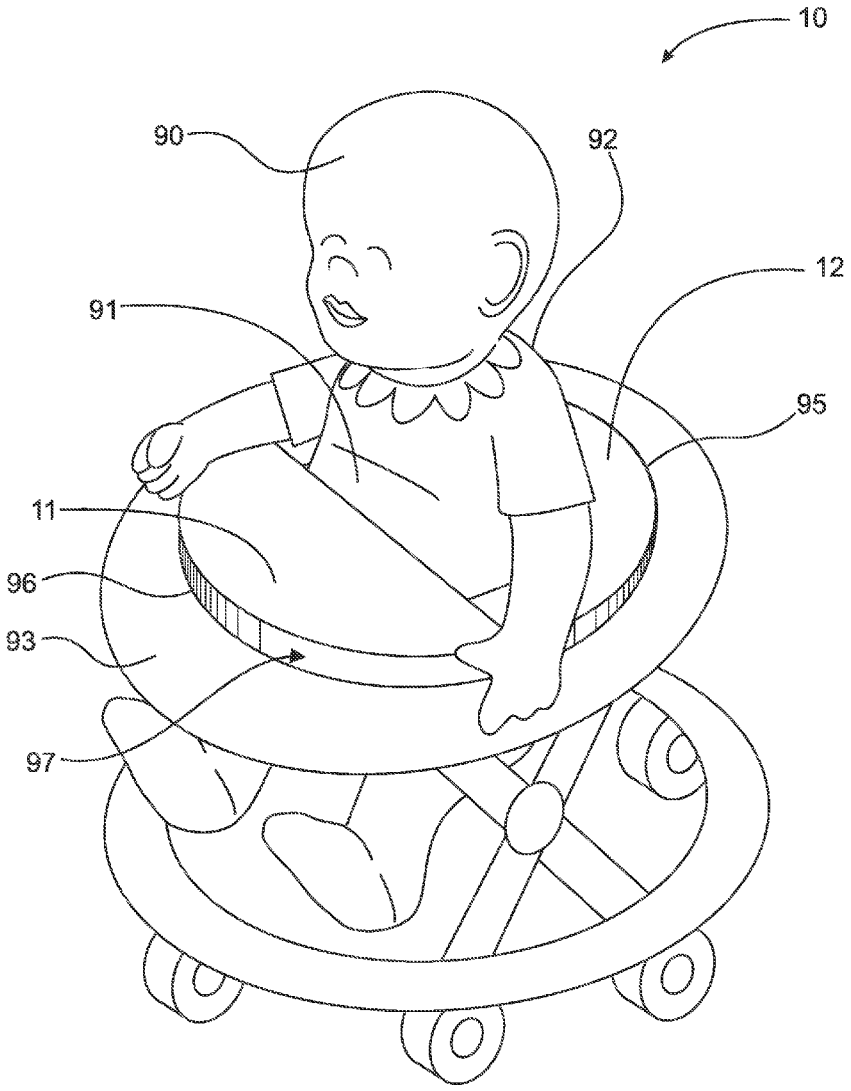
FIG. 1 is a perspective view of a present invention support insert assembly having a first member and a second member, shown holding an infant substantially upright while positioned in an entertainer.

FIG. 1 is a perspective view of present invention support insert assembly 10 having a first member and a second member, shown holding an infant substantially upright while positioned in an entertainer. Support insert assembly 10 includes member 12 having a substantially arcuate cross-section and member 11 having a substantially semicircular cross section. In an example embodiment, member 12 is positioned substantially perpendicular to the back surface of entertainer 93 and member 11 is positioned substantially perpendicular to the front surface of entertainer 93. FIG. 1 depicts support insert assembly 10 positioned within entertainer 93 such member 12 receives back 92 of infant 90 and member 11 engages front 91 of the infant, stabilizing infant 90, such that infant 90 remains in a substantially upright position.

Figure 3:
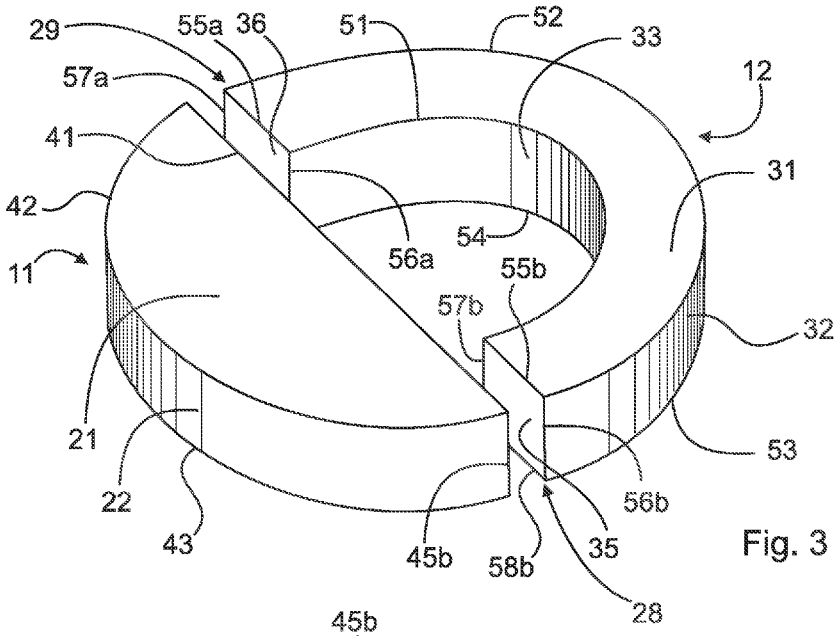
FIG. 3 is front perspective view of the support insert assembly shown in FIG. 1.

The present invention also includes a method of supporting infant 90 in an upright position in entertainer 93, where entertainer 93 includes front surface 96, back surface 95, and opening 97 for a seating arrangement for infant 90. First, member 12 is inserted into opening 97 of entertainer 93. As shown in FIGS. 1 and 3, member 12 includes curved side surface 32 and curved side surface 33 parallel to one another and end surface 35 and end surface 36 connected to curved side surface 32 and curved side surface 33. Curved side surface 32 is in contact with and substantially perpendicular to back surface 95 of entertainer 93. Second, member 11 is inserted into opening 97 of entertainer 93. Member 11 includes curved side surface 22 and straight side surface 23. Curved side surface 22 is in contact with and substantially parallel to front surface 96 of entertainer 93 and end surfaces 35, 36 are in contact with straight side surface 23. Third, infant 90 is positioned in opening 97. Members 11, 12 are arranged to form a space at least partially enclosed by straight side surface 23 and curved side surface 32. Front 91 of infant 90 is in contact with straight side surface 23 and back 92 of infant 90 is in contact with curved side surface 33. It should be appreciated that preferably members 11, 12 substantially fill opening 97 for the seating arrangement except for the at least partially enclosed space.

Figure 2:
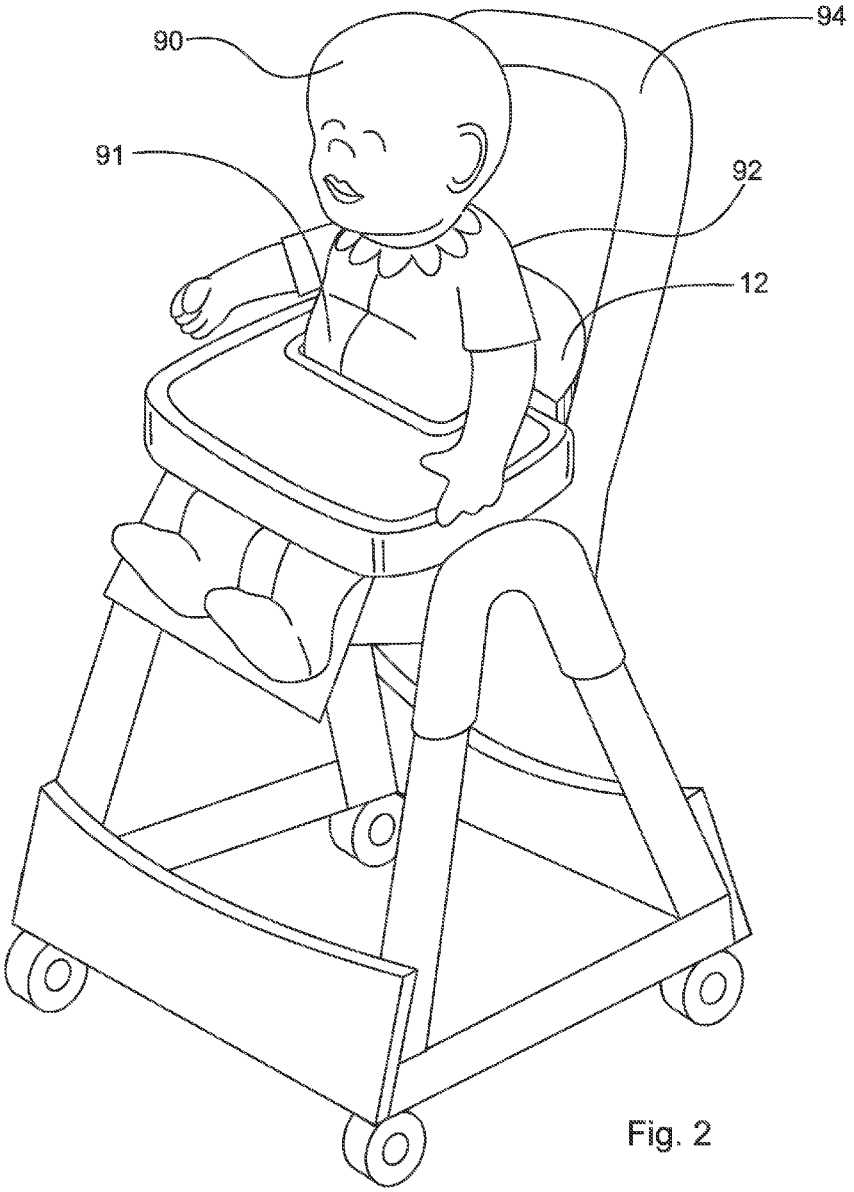
FIG. 2 is a perspective view of the first member, similar to that shown in FIG. 1, holding an infant substantially upright while positioned in a high chair with the second member removed.

FIG. 2 is a front perspective view of support insert assembly 10 shown in FIG. 1, with member 11 removed. In a second embodiment, member 12 positioned substantially perpendicular to the back surface of high chair 94. Back surface 92 of infant 90 rests upon first member 12 and front surface 91 of infant 90 rests upon the tray of the high chair, stabilizing infant 90 such that infant 90 remains in a substantially upright position. In this example embodiment, the angular edges of member 12 allow member 12 to fit securely within a device, such as a high chair, because the angular edges prevent member 12 from shifting unexpectedly.

FIG. 3 is front perspective view of the support insert assembly shown in FIG. 1.

Figure 4:
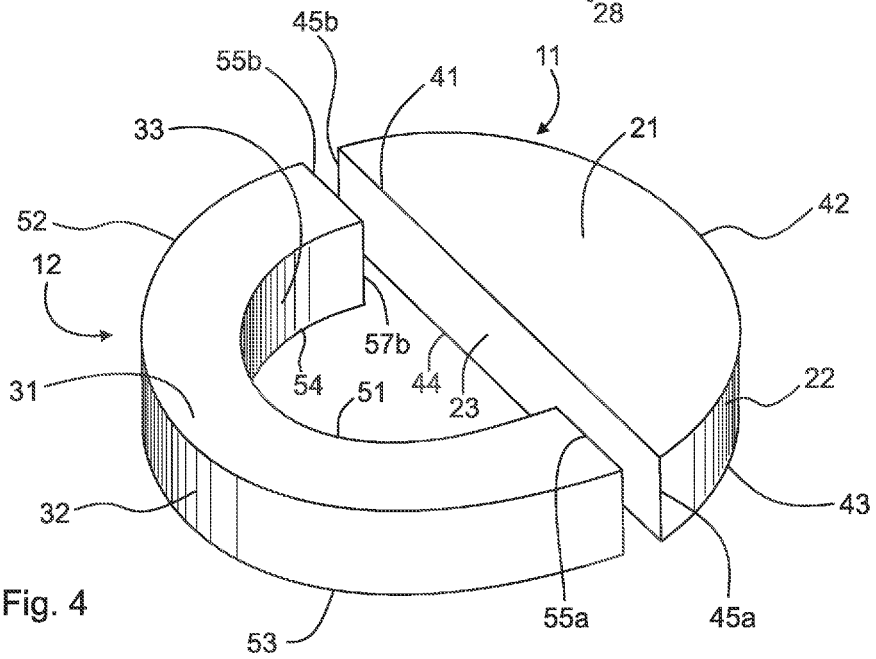
FIG. 4 is a rear perspective view of the support insert assembly shown in FIG. 1.

FIG. 4 is a rear perspective view of the support insert assembly shown in FIG. 1.

Figure 5:
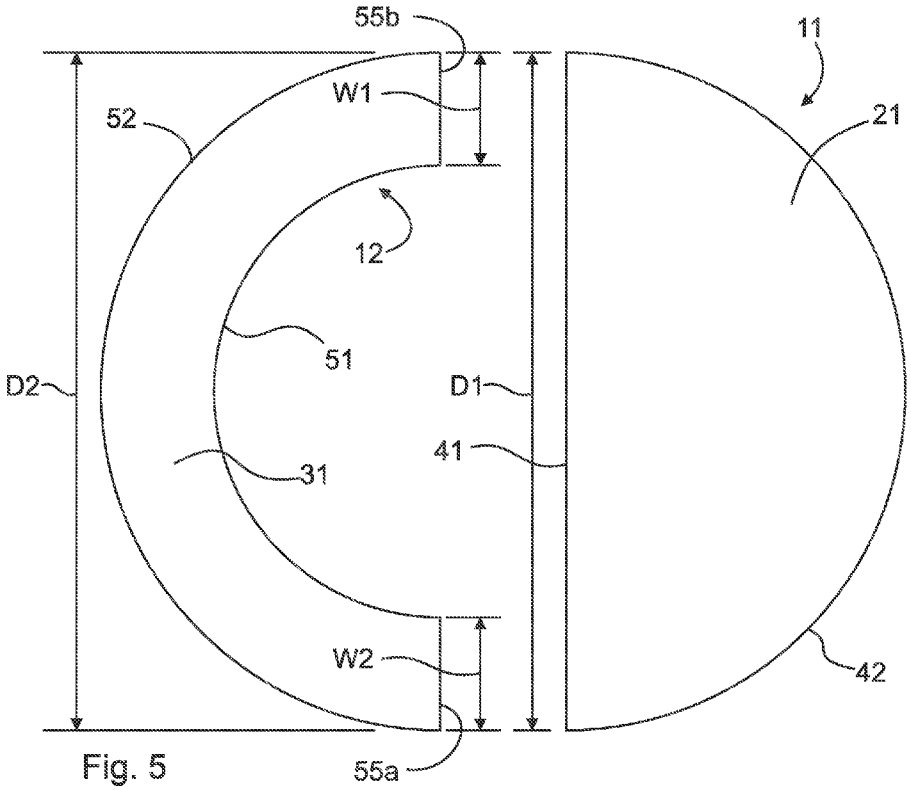
FIG. 5 is a top plan view of the support insert assembly shown in FIG. 1.
Figure 7:
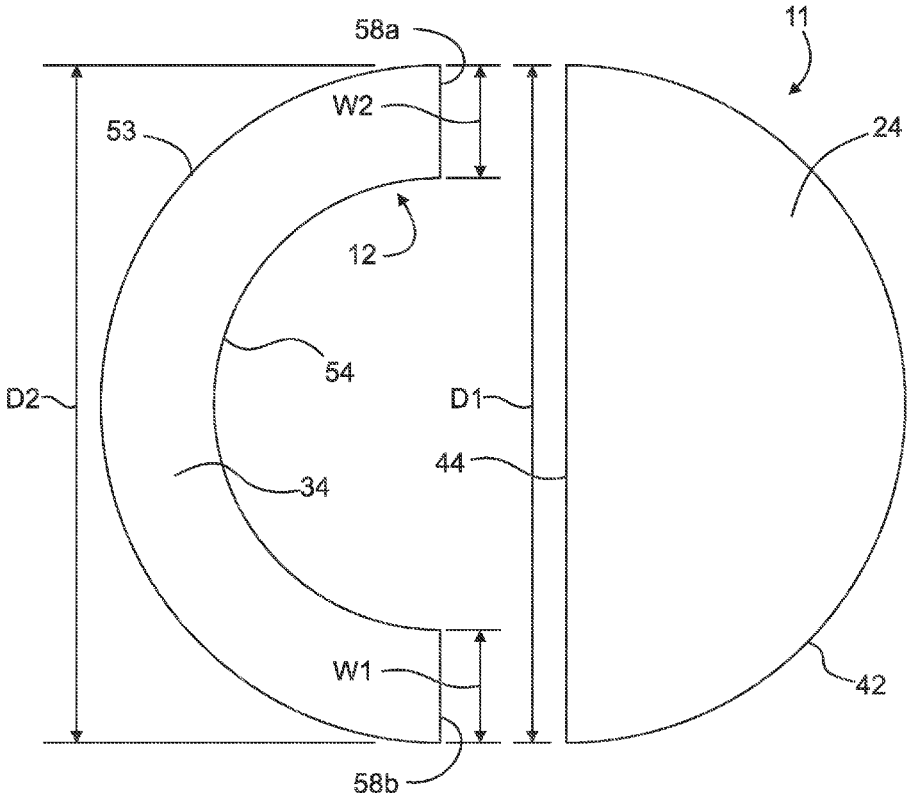

FIG. 5 is a top plan view of the support insert assembly shown in FIG. 1, while FIG. 7 is a bottom plan view of the support insert assembly shown in FIG. 1.

Figure 6:
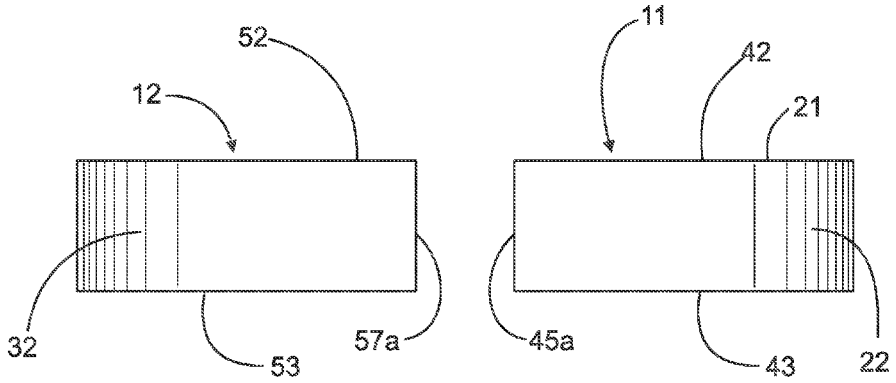
FIG. 6 is a rear elevational view of the support insert assembly shown in FIG. 1; and, FIG. 7 is a bottom plan view of the support insert assembly shown in FIG. 1.

FIG. 6 is a rear elevational view of the support insert assembly shown in FIG. 1. As shown in FIGS. 5 through 7, member 12 includes curved side surface 32, curved side surface 33, and distal portions 28 and 29. Distal, portion 28 includes end surface 35 and distal portion 29 includes end surface 36. Member 12 includes planar partial ring-shaped surface 31, and planar partial ring-shaped, surface 34 facing opposite surface 31. By "partial ring-shaped" we mean that surfaces 31 and 34 form a portion of respective rings. The distal portions are disposed opposite one another with respect to a diameter (hr the partial ring shape. Member 11 includes curved side surface 22, straight side surface 23, hemispherically-shaped planar surface 21, and hemispherically-shaped planar surface 24. As shown in the example arrangement displayed in FIGS. 3 and 4, member 12 and member 11 are operatively arranged to hold and stabilize a child when positioned in a device, for example, an entertainer, bouncer, or high chair. It should be appreciated however, that the support insert assembly can be positioned in any suitable device and is not limited for use with infants or young children. In an example embodiment, end surfaces 35, 36 of member 12 are arranged substantially parallel to and diametrically opposed to straight side surface 23 of member 11.

Member 12 further includes plurality of edges 51, 52, 53, 54, 55*a*, 55*b*, 56*a*, 56*b*, 57*a*, 57*b*, 58*a*, 58*b*, such that adjacent surfaces intersect forming corresponding edges at a substantially right angle. Preferably, edge 51 is formed by the intersection of planar partial ring-shaped surface 31 and curved side surface 33. Edge 52 is formed by the intersection of planar partial ring-shaped surface 31 and curved side surface 32. Edge 53 is formed by the intersection of curved side surface 32 and planar partial ring-shaped surface 34. Edge 54 is formed by the intersection of curved side surface 33 and planar partial ring-shaped surface 34. Edge 55*a* is formed by the intersection of planar partial ring-shaped surface 31 and end surface 36. Edge 56*a* is formed by the intersection of curved side surface 33 and end surface 36. Edge 57*a* is formed by the intersection of curved side surface 32 and end surface 36. Edge 58*a* is formed by the intersection of planar partial ring-shaped surface 34 and end surface 36. Edge 55*b* is formed by the intersection of planar partial ring-shaped surface 31 and end surface 35. Edge 56*b* is formed by the intersection of curved side surface 32 and end surface 36. Edge 57*b* is formed by the intersection of curved side surface 33 and end surface 36. Edge 58*b* is formed by the intersection of planar partial ring-shaped surface 34 and end surface 36.

Member 11 further includes plurality of edges 41, 42, 43, 44, 45*a*, 45*b*, such that adjacent surfaces intersect forming corresponding edges at a substantially right angle. Preferably, edge 41 is formed by the intersection of hemispherically-shaped planar surface 21 and side surface 23. Edge 42 is formed by the intersection of hemispherically-shaped planar surface 21 and arcuate surface 22. Edge 43 is formed by the intersection of curved side surface 22 and hemispherically-shaped planar surface 24. Edge 44 is formed by the intersection of straight side surface 22 and hemispherically-shaped planar surface 24. Edge 45*a* is formed by the intersection of straight side surface 23 and curved side surface 22. Similarly, edge 45*b* is formed by the intersection of straight side surface 23 and curved side surface 22. Therefore, the surfaces are generally orthogonal to one another.

FIG. 5 illustrates the similarity in size of member 12 and member 11. In an example embodiment, member 12 has diameter D2 of approximately 8 inches. End surface 36 and end surface 35 have width W2 and W1, respectively, and each width is approximately 3 inches. Member 11 has diameter D1 of approximately 8.5 inches.

FIG. 6 illustrates the convex curvature of curved side surface 32 and curved side surface 22 in contrast with angular edges, 52, 53, 57*a* and angular edges 42, 43, 45*a*.

In an example embodiment, support insert assembly 10 is made of a foam material. It should be appreciated that the support insert assembly can be made of any suitable material, such as polyurethane, latex, or polyester. Member 12 has been shown as C-shaped or U-shaped; however, it should be understood that other shapes are possible for member 12. It should be apparent that the support insert assembly can vary in size and shape. In another embodiment, member 12 includes a first cover and member 11 includes a second cover, where the first and second covers encase the first and second members, respectively. Furthermore, the first cover and the second cover are made of fabric. However, it should be appreciated that first and second covers can be made of any suitable material.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A support insert assembly for supporting a user in an upright position, comprising:
- a first member including:
  - first and second curved side surfaces parallel to one another;
  - first and second planar partial ring-shaped surfaces connecting the first and second curved side surfaces; and,
  - first and second end surfaces connected to the first and second curved side surfaces and the first and second planar partial ring-shaped surfaces; and,
- a second member including:
  - a third curved side surface;
  - a straight side surface in communication with the third curved side surface; and,
  - first and second hemispherically-shaped planar surfaces connected to the third curved side surface and the straight side surface and parallel to one another, wherein:
    - the first and second members are arranged to be located in an opening for a seating arrangement to form a space at least partially enclosed by the straight side surface and the first curved side surface, wherein the first and second members are removably disposed within the opening for the seating arrangement and the first and second members substantially fill the opening for the seating arrangement except for the at least partially enclosed space; and,
    - the space is arranged to receive the user, wherein the user has a front and a back, and the second curved side surface of the first member contacts and supports the back of the user and the straight side surface of the second member contacts and supports the front of the user, wherein when both the first member and the second member are disposed in the seating arrangement, the user is supported in a substantially upright position.

2. The support insert assembly of claim 1, wherein:
- the first and second planar partial ring-shaped surfaces form respective semi-circular rings; and,
- the first and second end surfaces are aligned with respective diameters for the respective semi-circular rings.

3. The support insert assembly of claim 2, wherein the first member and the second member are operatively arranged to support a child, such that when positioned in an apparatus, the first and second end surfaces of the first member are arranged substantially parallel to and diametrically opposed to the straight side surface of the second member.

4. The support insert assembly of claim 1, wherein the first member and the second member each further comprise a plurality of edges, such that the adjacent edges intersect at substantially right angles.

5. The support insert assembly of claim 1, wherein:
- the first and second planar surfaces form first and second semi-circular rings; and,
- the respective diameters for the first and second semi-circular rings are each approximately 8 inches.

6. The support insert assembly of claim 1, wherein the respective diameters for the first and second semi-circular rings and the respective diameters for the first and second hemispherically-shaped planar surfaces are substantially equal.

7. The support insert assembly of claim 2, wherein the first and second end surfaces each have a width wherein each of the widths is substantially parallel to the first and second planar partial ring-shaped surfaces and is approximately 3 inches.

8. The support insert assembly of claim 1, wherein the first and second hemispherically-shaped planar surfaces have respective diameters of approximately 8.5 inches.

9. The support insert assembly of claim 1, wherein the first member is substantially C-shaped.

10. The support insert assembly of claim 1, wherein the first member is substantially U-shaped.

11. The support insert assembly of claim 1, wherein the first member further comprises a first cover and the second member further comprises a second cover, wherein the first and second covers encase the first and second members, respectively.

12. The support insert assembly of claim 11, wherein the first cover and the second cover are made of fabric.

13. A support insert assembly for supporting a user in an upright position, comprising:
- a first member including:
  - first and second curved side surfaces parallel to one another;
  - first and second planar surfaces in the form of respective semi-circular rings parallel to another and connecting the first and second curved side surfaces; and,
  - first and second end surfaces connected to the first and second curved side surfaces and the first and second planar partial ring-shaped surfaces; and, a second member including:

a third curved side surface;

a straight side surface in communication with the third curved side surface; and, first and second hemispherically-shaped planar surfaces connected to the third curved side surface and the straight side surface and parallel to one another, wherein:

respective diameters for the respective semi-circular rings and the first and second hemispherically-shaped planar surfaces are equal;

the first and second members are arranged to be located in an opening for a seating arrangement to form a space at least partially enclosed by the straight side surface and the first curved side surface, wherein the first and second members are removably disposed within the opening for the seating arrangement and the first and second members substantially fill the opening for the seating arrangement except for the at least partially enclosed space; and, the space is arranged to receive the user, wherein the user has a front and a back, and the second curved side surface of the first member contacts and supports the back of the user and the straight side surface of the second member contacts and supports the front of the user, wherein when both the first member and the second member are disposed in the seating arrangement, the user is supported in a substantially upright position.

14. A method of supporting a user in an upright position in a device using a support assembly, including a first member with: first and second curved side surfaces parallel to one another; first and second planar partial ring-shaped surfaces connecting the first and second curved side surfaces; and first and second end surfaces connected to the first and second curved side surfaces and the first and second planar partial ring-shaped surfaces; and a second member with: a third curved side surface; a straight side surface in communication with the third curved side surface; and first and second hemispherically-shaped planar surfaces connected to the third curved side surface and the straight side surface and parallel to one another, the method comprising:

inserting the first member into an opening of a seating arrangement of the device;

inserting the second member into the opening of the seating arrangement of the device such that a space is formed between the first curved side surface and the straight side surface, wherein the first and second members are removably disposed within the seating arrangement and the first and second members substantially fill the opening for the seating arrangement except for the at least partially enclosed space; and, positioning the user in the space, wherein the user has a front and a back, and the second curved side surface of the first member contacts and supports the back of the user and the straight side surface of the second member contacts and supports the front of the user, wherein when both the first member and the second member are disposed in the seating arrangement, the user is supported in a substantially upright position.

15. The method of claim 14, further comprising:

positioning the first and second end surfaces of the first member parallel to and diametrically opposed to the straight side surface of the second member.

16. The method of claim 14, further comprising:

positioning the first and second end surfaces of the first member to contact the straight side surface of the second member.

* * * * *